US006745841B2

(12) United States Patent
Abercrombie Simpson

(10) Patent No.: US 6,745,841 B2
(45) Date of Patent: Jun. 8, 2004

(54) TUBE MANUFACTURE

(75) Inventor: Neil Andrew Abercrombie Simpson, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/102,626

(22) Filed: Mar. 20, 2002

(65) Prior Publication Data

US 2002/0166671 A1 Nov. 14, 2002

(30) Foreign Application Priority Data

Mar. 20, 2001 (GB) ..... 0106819

(51) Int. Cl.[7] ..... E21B 43/10

(52) U.S. Cl. ..... 166/380; 166/384; 166/207; 166/227; 83/54; 29/896.62; 29/33 T; 29/33 D

(58) Field of Search ..... 166/207, 227, 166/380, 381, 384; 138/177; 83/54; 29/33 D, 33 T, 896.6, 896.62

(56) References Cited

U.S. PATENT DOCUMENTS

| | | | | | |
|---|---|---|---|---|---|
| 1,053,614 | A | * | 2/1913 | Layne | 166/227 |
| 3,708,848 | A | * | 1/1973 | Guinard | 29/896.62 |
| 3,905,423 | A | | 9/1975 | Sparlin et al. | 166/296 |
| 4,343,359 | A | * | 8/1982 | Krause | 166/227 |
| 4,483,399 | A | * | 11/1984 | Colgate | 166/207 |
| 5,622,211 | A | | 4/1997 | Martin et al. | 138/177 |
| 5,695,008 | A | | 12/1997 | Bertet et al. | 166/187 |
| 6,354,373 | B1 | | 3/2002 | Vercaemer et al. | 166/277 |
| 6,454,493 | B1 | * | 9/2002 | Lohbeck | 166/380 |
| 6,457,533 | B1 | * | 10/2002 | Metcalfe | 166/381 |

FOREIGN PATENT DOCUMENTS

| | | | |
|---|---|---|---|
| EP | 0 952 305 | 10/1999 | E21B/43/10 |
| GB | 1 191 124 | 5/1970 | B21C/37/06 |
| GB | 1 237 325 | 6/1971 | B21C/37/06 |
| GB | 2 257 062 | 1/1993 | B21D/5/10 |
| GB | 2 347 446 | 9/2000 | E21B/43/10 |
| WO | WO 97/28920 | 8/1997 | B23D/45/12 |
| WO | WO 99/02818 | 1/1999 | E21B/43/10 |
| WO | WO 99/25524 | 5/1999 | B26F/1/00 |
| WO | WO 00/26500 | 5/2000 | E21B/19/22 |
| WO | WO 00/61310 | 10/2000 | B21C/37/08 |

OTHER PUBLICATIONS

Great Britain Search Report from Application No. GB 0106819.6, Dated Aug. 21, 2001.

PCT International Search Report from Application No. PCT/GB02/01328, Dated Jul. 5, 2002.

* cited by examiner

*Primary Examiner*—David Bagnell
*Assistant Examiner*—Matthew J Smith
(74) *Attorney, Agent, or Firm*—Moser, Patterson & Sheridan, L.L.P.

(57) ABSTRACT

A method of forming expandable downhole tubing (10) comprises the steps of: providing a tubing section (12) of a first diameter; forming apertures in the tubing section (12); and then reducing the diameter of the apertured tubing section.

23 Claims, 3 Drawing Sheets

TUBE MANUFACTURE

BACKGROUND OF THE INVENTION

1. Field of the Invention

This invention relates to a method of manufacturing a tube, and in particular to a method of manufacturing an expandable tube.

2. Description of the Related Art

Within the oil and gas exploration and production industry there have been recent significant developments in relation to the use of slotted expandable tubulars. Such tubulars comprise metal tubing sections in which the tubing wall defines a multiplicity of longitudinal overlapping slots. Once run downhole, the tubing may be expanded to a larger diameter, such expansion being accommodated by deformation of the metal in the tubing wall, and with the slots assuming the form of diamond-shaped apertures. Such slotted tubing has seen application as a support for unconsolidated formations, and as the base pipe for expandable sandscreens.

Currently, slotted tubing is manufactured by cutting slots in extruded tube using CNC abrasive water jetting techniques, or in some cases by the use of laser technology; an example of this is described in PCT/GB98/03478. These manufacturing methods produce a very high quality product, but are time-consuming; a 30–40 foot joint of tubing may take three to four hours to machine.

It is among the objectives of embodiments of the present invention to provide a less time-consuming method of producing slotted tubing.

SUMMARY OF THE INVENTION

According to one aspect of the present invention there is provided a method of forming expandable downhole tubing, the method comprising the steps of:

providing a tubing section of a first diameter;

forming apertures in the tubing section; and reducing the diameter of the apertured tubing section.

The reduced diameter tubing section may be subsequently expanded.

The apertures may axially overlap, but need not do so.

The apertures may be formed by any convenient means, most preferably by punching the apertures in the tubing section, which may be accomplished more easily when the tubing is positioned on a punching mandrel. Of course other aperture forming methods may be utilised, including drilling or other cutting methods.

The reduction in diameter of the apertured tubing may be achieved by any convenient method, most preferably by drawing the tubulars through reducing dies or swages.

The apertures may be of any convenient form, including diamond-shaped, circular, square, rectangular, hexagonal, oval or dog-bone-shaped. Typically, the apertures will be oriented and positioned to create an open lattice structure similar to an expanded or partially expanded conventionally slotted tubing. In the reduced diameter tubing, the apertures will generally tend to assume a more longitudinal slot-like form, and in some instances may partially or completely close.

In most metal tubulars, the diameter reduction step will produce a degree of work-hardening, however in many metals, such as low carbon and alloy steels, the extent of work hardening would not be such to create difficulties in re-expansion. However, the reduced diameter tubing section may be subject to annealing, or some other stress-relieving process, to facilitate subsequent expansion.

If desired, the reduced diameter tubing could be flattened and reeled, for example as described in WO00\26500, for transportation and subsequent unflattening.

In further aspects of the invention, expandable tubing may be produced by:

providing tubing; and forming apertures in the wall of the tubing by parting the material of the tubing.

The parting may be achieved by shearing or punching, and in one embodiment the tubing wall may be passed between appropriate punching rollers.

As the parting of the material, typically a metal, creates little if any waste or scrap, this method may prove more economic than methods in which apertures are formed by removal of material.

In other aspects of the invention, tubing may be produced by:

forming apertures in a sheet of a first width;

forming the sheet into a tube of a first diameter; and reducing the diameter of the tube.

Alternatively, the width of the apertured sheet may be reduced prior to forming the sheet into a tube.

In another aspect of the present invention, tubing may be produced by:

forming apertures in a sheet by parting the sheet material; and forming the apertured sheet into an expandable tube.

This aspect of the invention has the advantage that there is no waste material produced in the creation of the apertures.

Preferably, the apertures are created by shearing or punching, for example by being passed between a pair of punch rollers. This will tend to create an uneven sheet, which may be flattened before being formed into a tube.

In the aspects of the invention utilising sheet, the tube may be formed by any convenient method, and the edges of the sheet may be welded, or joined by other methods, for example by means of mechanical fasteners.

The sheet may initially be formed into a flattened tube and subsequently unflattened.

In certain of the above aspects of the invention the tubing may be dipped or coated in a fluid material which subsequently hardens or solidifies, the material filling the apertures in the tubing wall. On subsequent expansion of the tubing the material may tear or elongate. This aspect of the invention may also be utilised in relation to conventional slotted or apertured tubing.

The material preferably closes the apertures in the tubing wall such that the tubing wall is rendered fluid tight, and may be pressure-tight, at least in one radial direction. In particular, where wedge-shaped apertures are formed in the tubing wall, that is where the diameter, width or length of an aperture is greater towards the outer surface of the wall than towards the inner surface of the wall, the tubing wall may be pressure-tight with respect to external pressure; this aperture configuration will occur as a matter of course where for example, vertical or straight-sided apertures are cut in a sheet which is then formed into a tube having a longitudinal seam. The material filling the apertures, for example zinc from hot dip galvanising or an elastomeric coating from spraying the tube exterior with a curable rubber composition, will form wedge-shaped plugs in the apertures, and even relatively soft or ductile material may withstand external pressure as the wedges of material will tend to be pushed down into the apertures. This may facilitate running the tubing into a bore, as the tubing may then be run safely through a lubricator or packing into a pressurised well.

The references above to apertures are primarily intended to refer to openings in the tubing wall. However, those of skill in the art will realise that many of the effects and benefits of the invention may be achieved by only weakening or thinning the tubing wall material, and not necessarily by forming a through passage or complete parting of the material. For example, it may be sufficient to punch the wall to create a line or area of weakness which will subsequently fail or extend to allow subsequent expansion. Of course this offers the advantage that the tubing is, initially at least, pressure-tight.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
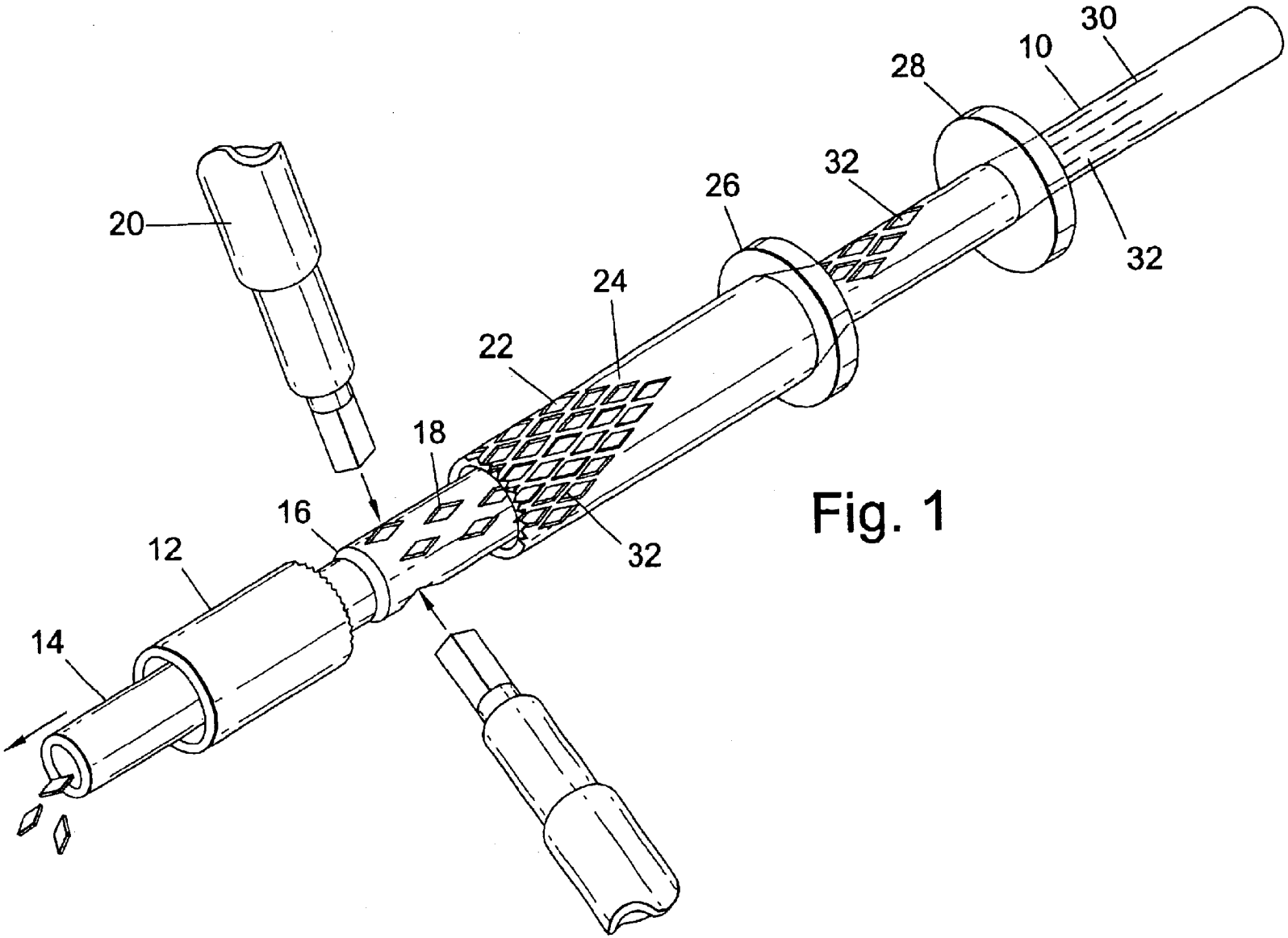
FIG. 1 is a schematic perspective view of an expandable tubing forming process, in accordance with a preferred embodiment of the present invention.

Reference is first made to FIG. 1 of the drawings, which illustrates a process of creating expandable slotted tubing 10, for use in downhole applications, from solid-walled tubing 12. The solid tubing 12 may be of any appropriate material, but will typically be formed of steel or another iron-based alloy. Conveniently, the tubing 12 will be processed in sections or joints of 30–40 feet long, but may be processed in a continuous length.

The tubing 12 is fed forward over a tubular tie bar 14 followed by a punch die 16 having an outer diameter slightly smaller than the inner diameter of the tubing 12, and defining a number of diamond-shaped apertures 18. Located around the die 16 are a number of hydraulic punches 20 (some punches have been omitted for clarity), each punch 20 being aligned with a respective aperture 18.

The punches 20 are actuated at appropriate intervals, as the tubing 12 advances over the die 16, to create a pattern of overlapping diamond-shaped apertures 22. The waste material is passed out of the die 16 and through the tie bar 14. The thus perforated tube 24 (only some of the perforations are shown) is then passed through two swaging dies 26, 28 which reduce the diameter of the tube 24 to an extent that the apertures 22 become overlapping longitudinal slots 30 in the wall of a smaller diameter tubing 10. The diameter reduction of the tube 24 is accommodated, for the most part, by the bending of the metal forming the webs 32 between the apertures 22.

The resulting slotted tubing lengths may subsequently be provided with end connectors, which connectors may be machined into the ends of the tubing 10, or mounted to the ends of the tubing 10.

Figure 4:
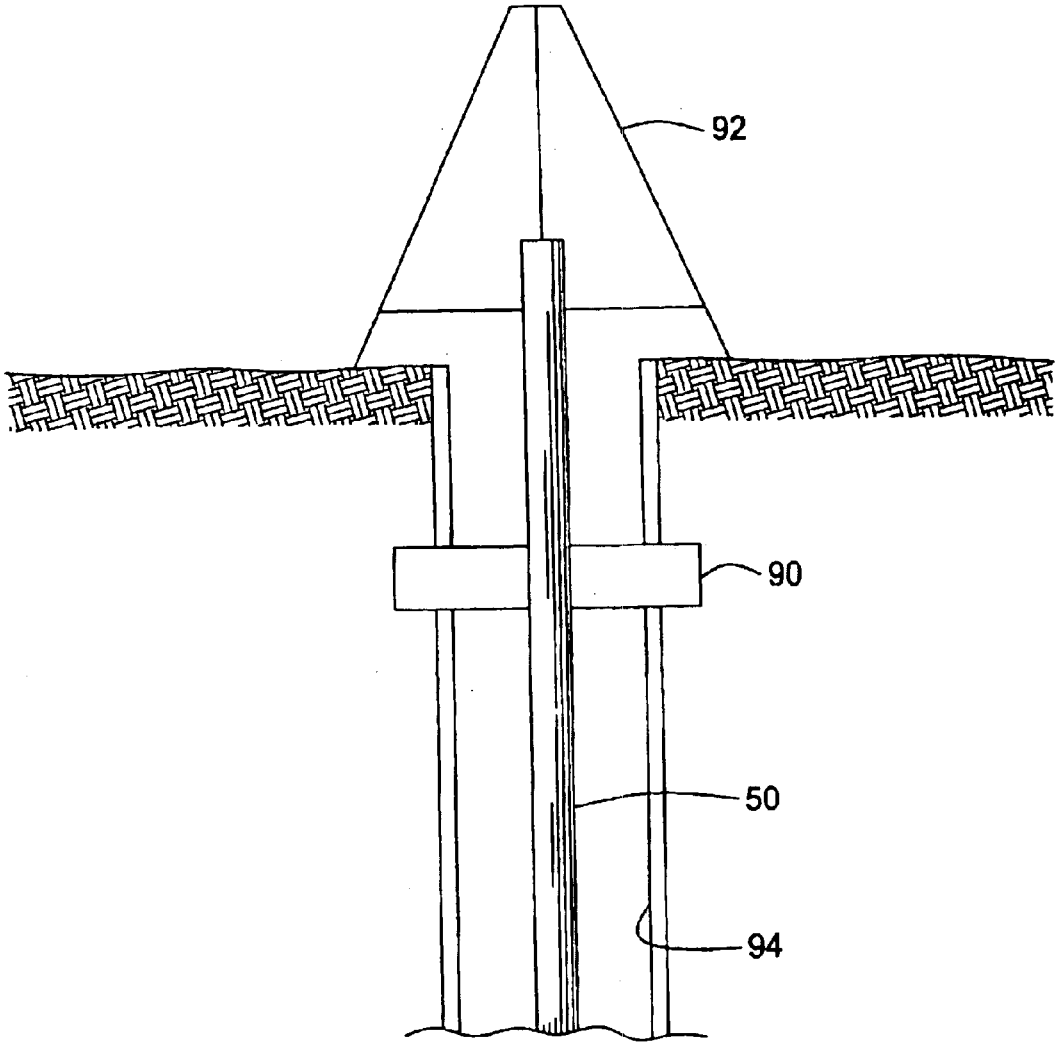
FIG. 4 depicts a tubing being expanded in a wellbore.

In one application the tubing lengths will be transported to a drilling location, and made-up into an expandable tubular string which is run-in to a bore. Once in the desired location, the string is expanded to a larger diameter by any appropriate method, for example by means of an axially moving expansion cone or mandrel, or by rotary expansion, as described in PCT\GB99\04225. As shown in FIG. 4, the tubing 50 is being expanded by a rotary expansion tool 92.

The expansion process is accommodated primarily by bending of the metal forming the webs 32, and results in re-opening of the slots 30 to the original diamond-shaped apertures 22. Of course, the diameter of the expanded tubing may be greater than or less than the diameter of the original tubing 12.

Figures 2, 3:
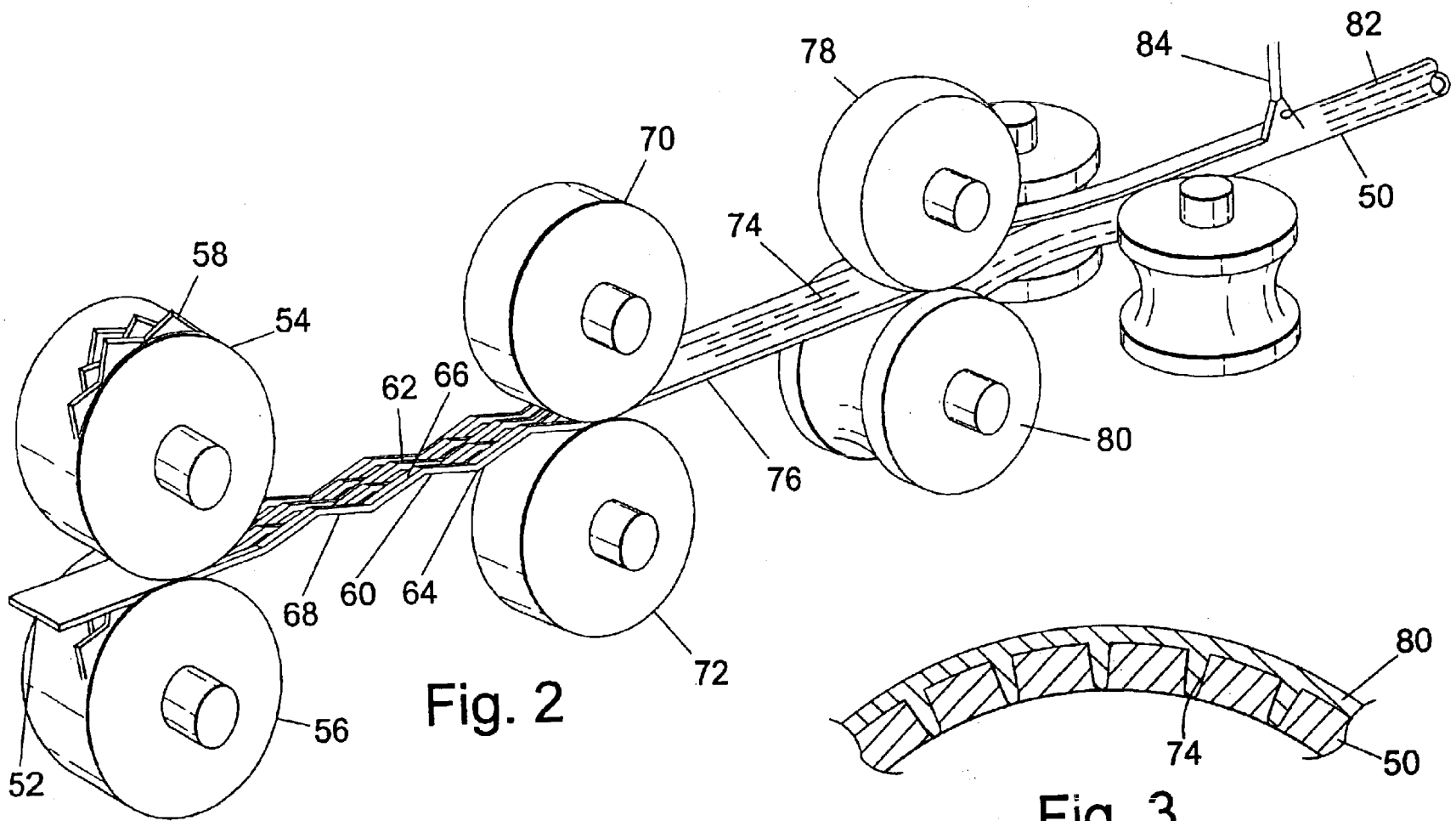
FIG. 2 is a schematic perspective view of an expandable tubing forming process, in accordance with a further embodiment of the present invention.
FIG. 3 is an enlarged sectional view of a portion of expandable tubing as produced by the process of FIG. 2.

Reference is now made to FIG. 2 of the drawings, which illustrates an alternative process of forming expandable slotted tubing 50. In this process, a plain strip of steel 52 is first passed between a pair of punch rollers 54, 56, each featuring circumferential rows of triangular protrusions 58. The rollers 54, 56 are arranged such that the strip 52 is deformed to create longitudinal "zig-zag" rows 60, and between the peaks and troughs 62, 64 of adjacent rows 60 the metal of the strip parts to create apertures 66.

The apertured strip 68 is then passed between a pair of flattening rollers 70, 72, which flatten the apertured strip 68, while retaining the apertures 66 in the form of longitudinal slots 74. The resulting slotted sheet strip 76 is then passed between two pairs of forming rollers 78, 80, which bend the strip 76 to form a cylindrical tube 50. The tube form is retained by an intermittent weld 82, produced by appropriate welding apparatus 84, along the meeting edges of the strip.

The resulting slotted tubing 50 may be used, in the same manner as conventional slotted tubing as, for example, an expandable bore liner or expandable sand screen support. However, the tubing 50 may be manufactured more quickly than by using conventional cutting techniques.

The tubing may be subject to further processing, such as annealing or other stress-relieving heat treatment. The tubing 50 may also be coated with another material 80, as illustrated in FIG. 3 of the drawings, such as a settable elastomer, or by hot-dipping in a zinc bath. Such coating operations may be controlled such that the coating 80 seals the slots 74. Thus, the resulting tubing 50 may be pressure-tight, particularly when a higher pressure is experienced externally of the tubing 50; following the bending of the strip to form the tubing 50, the apertures 74 may assume a wedge-shape, such that external pressure may push the coating material 80 deeper into the slots 74, but is less likely to push the material out of the slots 74, as this would entail extrusion of the material through the relatively narrow base of a wedge-shaped slot 74. Following expansion, the coating material may extend or part such that the expanded tubing is no longer pressure-tight. This may facilitate running the tubing 50 into a bore 94, as the tubing 50 may then be run safely through a lubricator or packing 90 into a pressurised well, as shown in FIG. 4. FIG. 4 illustrates the tubing 50 suspended by a drilling rig 92 as the tubing 50 is run into the bore 94.

Those of skill in the art will recognise that these embodiments are merely exemplary of the present invention and that various modifications and improvements may be made thereto, without departing from the scope of the invention.

What is claimed is:

1. A method of forming expandable downhole tubing, the method comprising:

providing a tubing section of a first diameter;

forming apertures in the tubing section; and reducing the first diameter of the apertured tubing section to a smaller second diameter, wherein a cross-sectional area of the tubing section is reduced.

2. A method of lining a bore, comprising running the reduced diameter apertured tubing section produced by the method of claim 1 into a bore, and then expanding the tubing section in the bore to a larger diameter.

3. The method of claim 1, comprising forming the apertures in the tubing section such that adjacent apertures axially overlap.

4. The method of claim 1, comprising punching the apertures in the tubing section.

5. The method of claim 4, comprising punching the apertures while the tubing section is positioned on a punching mandrel.

6. The method of claim 1, comprising reducing the diameter of the apertured tubing section by drawing the tubing section through reducing dies.

7. The method of claim 1, comprising forming diamond-shaped apertures.

8. The method of claim 1, comprising orienting and positioning the formed apertures to create an open lattice structure.

9. The method of claim 1, wherein following reducing the diameter of the apertured tubing section to a smaller second diameter the apertures assume a longitudinal slot-like form.

10. The method of claim 1, further comprising coating the tubing in a fluid material which subsequently hardens, such that the material fills the apertures.

11. A method of running tubing into a bore, comprising running the tubing produced by the method of claim 10 into a bore through one of a lubricator or packing.

12. The method of claim 10, wherein the apertures comprise wedge-shaped apertures.

13. The method of claim 10, wherein the fluid material comprises zinc or elastomeric material.

14. The method of claim 1, wherein the apertures comprise wedge-shaped apertures.

15. A method of forming expandable downhole tubing, the method comprising:

forming apertures in a sheet of a first width;

forming the sheet into tubing of a first diameter; and reducing the first diameter of the tubing.

16. The method of claim 15, further comprising coating the tubing in a fluid material which subsequently hardens, such that the material fills the apertures.

17. A method of running tubing into a bore, comprising running the tubing produced by the method of claim 16 into a bore through one of a lubricator or packing.

18. A method of forming expandable downhole tubing, the method comprising the steps of:

providing a tubing section of a first diameter;

forming apertures in the tubing section; and reducing the diameter of the apertured tubing section to a smaller second diameter by drawing the tubing section through reducing dies.

19. A method of forming expandable downhole tubing, the method comprising the steps of:

providing a tubing section of a first diameter;

forming diamond-shaped apertures in the tubing section; and reducing the diameter of the apertured tubing section to a smaller second diameter.

20. A method of forming expandable downhole tubing, the method comprising the steps of:

forming apertures in a sheet by punching the sheet material; creating an uneven sheet material;

flattening the uneven sheet material; and forming the flattened sheet material into expandable tubing.

21. The method of claim 20, comprising passing the sheet between punch rollers to form the apertures.

22. A method of forming expandable downhole tubing, comprising:

providing a tubing section of a first diameter;

forming apertures in the tubing section;

reducing the first diameter of the apertured tubing section to a smaller second diameter; and coating the tubing section in a fluid material which subsequently hardens, such that the material fills the apertures.

23. A method of running tubing into a bore, comprising running the tubing produced by the method of claim 22 into a bore through one of a lubricator or packing.

* * * * *